United States Patent [19]

Malyuk

[11] 4,398,375

[45] Aug. 16, 1983

[54] HIGH SPEED POWER SANDER AND SANDING PAD THEREFOR

[76] Inventor: John Malyuk, 25670 Zeman Ave., Euclid, Ohio 44132

[21] Appl. No.: 334,155

[22] Filed: Dec. 24, 1981

[51] Int. Cl.[3] ..... B24B 23/00

[52] U.S. Cl. ..... 51/170 TL; 51/170 MT; 51/358

[58] Field of Search ..... 51/170 TL, 170 MT, 170 R, 51/170 T, 358, 363, 362, 382, 386, 387

[56] References Cited

U.S. PATENT DOCUMENTS

| | | | |
|---|---|---|---|
| 2,990,661 | 7/1961 | Hackett | 51/379 |
| 3,261,049 | 7/1966 | Murphy | 51/358 |
| 3,510,992 | 5/1970 | Hutchins | 51/378 |
| 3,892,091 | 7/1975 | Hutchins | 51/170 TL |
| 3,900,976 | 8/1975 | Kitts, Jr. | 51/362 |
| 4,206,574 | 6/1980 | Dotsko | 51/363 |

*Primary Examiner*—Roscoe V. Parker

*Attorney, Agent, or Firm*—Maky, Renner, Otto & Boisselle

[57] ABSTRACT

A high speed reciprocating or orbiting power sander to the back-up plate of which a sanding pad of resiliently deformable elastomeric material is secured, the pad having numerous discrete laterally projecting fingers with coplanar rounded ends engaged with, but unsecured to, the uncoated side of the sandpaper. When the sander is in operation the rounded ends of the fingers have a back and forth or circular massaging action on the sandpaper to quickly achieve smooth finishes on the work being sanded, to prevent clogging of the sandpaper, and to greatly increase the life of the sandpaper.

6 Claims, 3 Drawing Figures

HIGH SPEED POWER SANDER AND SANDING PAD THEREFOR

BACKGROUND OF THE INVENTION

In known high speed reciprocating or orbiting power sanders the sandpaper is backed up by a layer of felt or rubber-like sponge material cemented to the reciprocating or orbiting back-up plate of the sander. It is also known, as in Hutchins U.S. Pat. Nos. 3,510,992 and 3,892,091 to provide a sanding pad of closed pore sponge material having an irregularized surface to which the uncoated side of the sandpaper is cemented. Although such known sanding pads provide a resilient back-up for the sandpaper for uniform distribution of pressure of the sandpaper against the work, the sandpaper rather quickly becomes clogged with build-up of sanded material thereon. Furthermore, sanders equipped with such known sanding pads do not effectively sand away high spots in the work and it is difficult and time consuming to achieve glass-smooth finishes on the work.

SUMMARY OF THE INVENTION

In contradistinction to known sanding pads, the sanding pad constituting the present invention provides numerous spaced apart resilient rubber-like fingers which have co-planar rounded ends engaged with, but unsecured to, the uncoated side of the sandpaper to provide a laterally resilient support for the sandpaper by reason of the resilience of the projections or fingers in the axial direction thereof. In operation of the sander at high speed, whether in a straight line reciprocating motion or in an orbital motion, the fingers flex laterally about their bases so that the rounded ends thereof exert a massaging action on the sandpaper which greatly increase the life of the sandpaper and which effectively remove high spots in the work to attain a glass-smooth finish on the work in a much shorter period of time than in cases employing conventional sanding pads of felt or rubber-like sponge material.

DETAILED DESCRIPTION OF A PREFERRED EMBODIMENT

Figure 1:
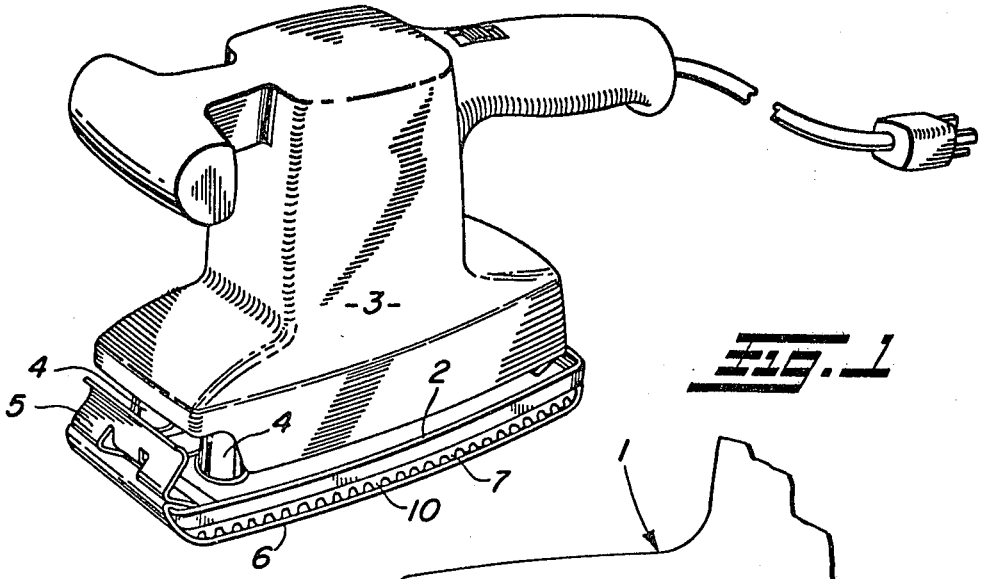
FIG. 1 is a perspective view of a high speed dual action sander providing for reciprocating motion or orbiting motion of the back-up plate to which the sandpaper is secured with the sanding pad constituting the present invention interposed between the back-up plate and the uncoated side of the sandpaper.
Figure 2:
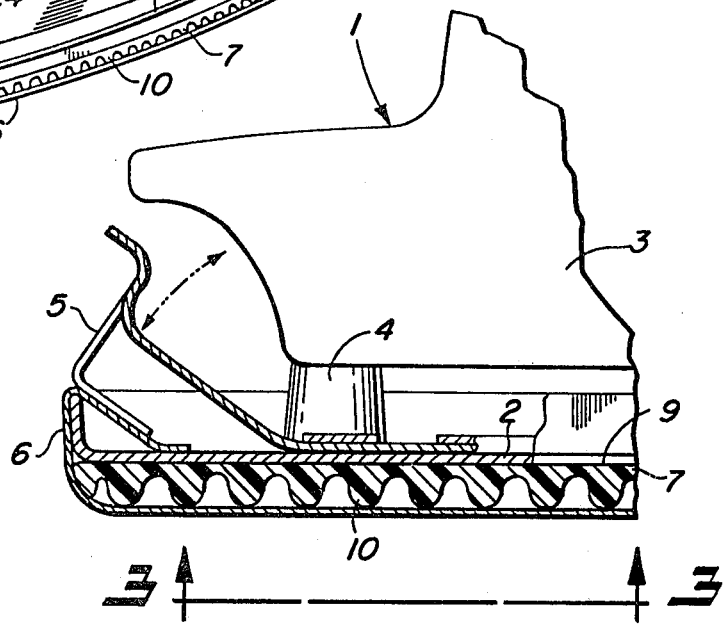
FIG. 2 is a partial longitudinal cross-section view on an enlarged scale showing the resilient sanding pad of the present invention secured to the bottom surface of the reciprocating or orbiting plate of the sander and the round end fingers or projections of the pad engaging the uncoated side of the sandpaper.
Figure 3:
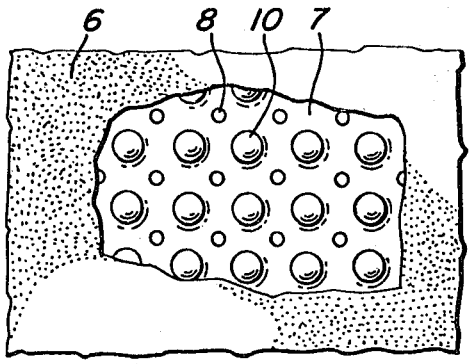
FIG. 3 is a bottom plan view as viewed along the line 3—3 of FIG. 2 with a portion of the sandpaper cut away to show the crisscross rows of round end fingers or projections of the sanding pad herein.

FIG. 1 shows a dual action electric motor operated sander 1 having a base plate 2 (usually $3\frac{1}{4}'' \times 7''$) supported from the drive housing 3 by resilient feet 4. As known, dual action sanders 1 may be operated to horizontally reciprocate the base plate 2 lengthwise thereof or to orbit the base plate 2 about its vertical axis. In a sander 1 of the type shown, the average reciprocating or orbiting stroke may be about 3/16" although some pneumatic sanders may have a greater stroke such as 5/16". Generally sanders 1 of the character indicated may be operated from about 4,000 to 10,000 oscillations per minute with the average being about 7,000 oscillations per minute.

The sander 1 herein is provided with spring clips 5 at its ends for clamping a strip of sandpaper 6 to extend over the bottom of the base plate 2 with the sanding pad 7 constituting the present invention interposed between the base plate 2 and the sandpaper 6.

The sanding pad 7 comprises a sheet of resilient rubber-like material which, for example, may be about 1/16" thickness with perforations 8 therethrough which decrease the amount of material required to mold the sanding pad 7 and which, in addition, serve to anchor the pad 7 when it is cemented to the backing plate 2 as with contact cement. However, it is preferred that the upper surface of the sanding pad 7 be provided with a pressure sensitive adhesive 9 to render the sanding pad 7 readily removable should it be desired to replace the same. The sanding pad 7 is of generally rectangular form of the same size as the back-up plate 2 and the sandpaper 6 therebeneath. The sanding pad 7 has crisscross rows of integral downwardly extending downward projecting nipples or fingers 10 which have rounded bottom ends (preferably hemi-spherical) lying in a common plane and engaged with, but unsecured to, the upper uncoated side of the sandpaper 6. The fingers 10 are generally cylindrical and of vertical height greater than the diameter thereof, the fingers 10 being slightly tapered to facilitate molding and terminating in radiused bases which eliminate high stress concentration as the fingers 10 laterally flex in a reciprocating or orbiting motion of the rounded ends thereof. The diameter of the fingers 10 is preferably about 3/16" and the center-to-center distance between the crisscross rows of fingers is $\frac{3}{8}''$. The fingers 10 are preferably from $\frac{1}{4}''$ to $\frac{3}{8}''$ in height, $\frac{1}{4}''$ height being preferred for sanding of wood and $\frac{3}{8}''$ height being preferred for automotive or like work in sanding sheet metal. Fingers 10 of about 5/16" height have been found to provide good results both on wood and metal.

As previously indicated the sanding pad 7 is of resilient rubber-like material which would include rubber but preferably is of neoprene or polyurethane, the latter being tougher than neoprene. The sanding pad should have a hardness from 30 to 40 Durometer with 35 Durometer being the preferred hardness. It has been found that a pad 7 of 25 or 45 Durometer hardness is either too soft or too hard to achieve the desired optimum results.

When the sandpaper 6 is attached to the sander 1 as by means of the spring clips 5, the sandpaper 6 will be resiliently supported in flat condition by the resilience of the fingers 10 in the vertical axial direction to smooth over high spots on the work. In operation, whether the sander be set for reciprocating motion or orbiting motion at the high speed indicated, the fingers 10 will flex laterally about their radiused bases whereby the rounded ends will exert a back and forth or circular massaging action on the sandpaper 6 to prevent build-up of sanded material on the bottom surface of the sandpaper 6. It has been found that the life of the sandpaper 6 when backed up by the sanding pad 7 herein is 3 to 4 times the life of the sandpaper which is backed up by known pads of felt or rubber-like sponge material.

It is to be understood that the word "sandpaper" as used herein includes emery paper or cloth, wet or dry garnet paper, etc.

It is believed that the air spaces defined between the fingers 10 and the sandpaper 6 contribute to a cooling action and in the case of operating the sander 1 with orbital motion the sanded material is blown out radially as a constant stream. On wood, smoother finishes have been obtained in a shorter time period that with known sanders and, of course, the much longer life of the sandpaper not only saves in the cost of the sandpaper but also in the time required to frequently replace the sandpaper in existing sanders.

The embodiments of the invention in which an exclusive property or privilege is claimed are defined as follows:

1. A high speed power sander having an oscillating back-up plate to which one side of a sanding pad 30 to 40 Durometer hardness resiliently deformable elastomeric material is secured; said pad having on the other side numerous integral spaced apart discrete laterally projecting generally cylindrical fingers of height at least as great as the diameter thereof and terminating in coplanar rounded ends; and means on said plate for detachably securing thereto the ends of a strip of sandpaper with the uncoated side engaged with, but unsecured to, said rounded ends whereby said fingers constitute a resilient support for the sandpaper when pressed against work to be sanded and are flexed to cause the rounded ends thereof to exert a massaging action on the sandpaper to prevent clogging thereof by sanded material of the work and to form a smooth finish on the work.

2. The sander of claim 1 wherein said fingers are of height not greater than about twice the diameter thereof.

3. The sander of claim 1 wherein said fingers are spaced apart a center-to-center distance about twice the diameter thereof.

4. A rectangular sanding pad for attachment to the oscillatable back-up plate of a high speed power sander comprising a sheet of 30 to 40 Durometer hardness rubber-like resiliently deformable material having numerous integral spaced apart discrete laterally projecting generally cylindrical fingers of height at least as great as the diameter thereof and terminating in coplanar rounded ends adapted to form a resilient support for sandpaper affixed to said plate; said fingers during oscillation being adapted to be flexed to cause the rounded ends to exert a massaging action on the sandpaper.

5. The sanding pad of claim 4 wherein said fingers are of height not greater than about twice the diameter thereof.

6. The sanding pad of claim 4 wherein said fingers are spaced apart a center-to-center distance about twice the diameter thereof.

* * * * *